US006397648B1

(12) United States Patent
Morris et al.

(10) Patent No.: US 6,397,648 B1
(45) Date of Patent: Jun. 4, 2002

(54) U-LOCK KEYWAY PROTECTOR

(75) Inventors: Jason A. Morris, Malden; John D. Fiegener, Marblehead; Cornelius McDaid, Randolph, all of MA (US)

(73) Assignee: Kryptonite Corporation, Canton, MA (US)

( * ) Notice: Subject to any disclaimer, the term of this patent is extended or adjusted under 35 U.S.C. 154(b) by 0 days.

(21) Appl. No.: 09/821,438

(22) Filed: Mar. 30, 2001

(51) Int. Cl.[7] ..... E05B 17/18

(52) U.S. Cl. ..... 70/423; 70/38 A; 70/39; 70/455

(58) Field of Search ..... 70/38 A, 39, 54–56, 70/423–428, 455

(56) References Cited

U.S. PATENT DOCUMENTS

| | | | | | |
|---|---|---|---|---|---|
| 458,496 | A | * | 8/1891 | Rives et al. | 70/423 |
| 652,649 | A | * | 6/1900 | Stephens | 70/423 |
| 850,446 | A | * | 4/1907 | Robbins | 70/423 |
| 1,062,594 | A | | 5/1913 | Isidor | |
| 1,811,141 | A | | 6/1931 | Leventhal | |
| 2,491,337 | A | * | 12/1949 | Segal | 70/455 |
| 3,077,101 | A | * | 2/1963 | Jacobi | 70/455 |
| 3,444,712 | A | * | 5/1969 | Greenwald | 70/423 |
| 4,541,260 | A | * | 9/1985 | Rubinstein et al. | 70/425 |
| 4,584,855 | A | | 4/1986 | Burlingame | 70/38 A |
| 4,739,639 | A | * | 4/1988 | Balasingam | 70/355 |
| 4,793,165 | A | * | 12/1988 | Rochman | 70/425 X |
| 5,092,142 | A | | 3/1992 | Zane et al. | 70/39 |
| 5,535,609 | A | | 7/1996 | Kuo | 70/423 |
| 5,832,762 | A | | 11/1998 | McDaid | 70/455 |

* cited by examiner

*Primary Examiner*—Lloyd A. Gall
(74) *Attorney, Agent, or Firm*—Morse, Altman & Martin

(57) ABSTRACT

A keyway protector having housing and the slider. The housing hugs the crossbar of a U-lock and secured by screws. The slider fits into a shallow depression in the inner surface of the housing and moves between open and closed positions. In the open position, an aperture in the housing, a hole in the slider, and the keyway are aligned to allow access to the keyway. In the closed position, the slider hole is not aligned, denying access to the keyway. A knob outside the housing is used to move the slider. Protrusions in opposed pivoting arms on the slider snap into opposed notches in the depression walls to hold the slider in the open or closed position.

4 Claims, 3 Drawing Sheets

U-LOCK KEYWAY PROTECTOR

CROSS-REFERENCES TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to bicycle and motorcycle U-locks, more specifically, to a cover for protecting the keyway of a U-lock from the environment.

2. Description of the Related Art

Since the invention of the bicycle and motorcycle lock comprising a U-shaped shackle and a tubular crossbar, the U-lock has become a favorite. The original U-lock has its keyway, the access point through which a key is used to secure the shackle to the crossbar, at the end of the crossbar. A major improvement in the design of the U-lock occurred when the keyway was moved from the end of the crossbar, where it was vulnerable to attack by someone intent on destroying the lock, to the side of the crossbar between the shackle legs, as described in U.S. Pat. No. 5,010,746. Although much less vulnerable to attack, the side-located keyway is more vulnerable to the environment, particularly dirt and mud, than the end-located keyway of the original U-lock. When not being used to the secure a vehicle, the original U-lock was typically held by a bracket that at least partially protected the keyway from the environment. The side-located keyway does not receive the same protection by a holding bracket. In addition, newer methods for holding U-locks, such as the U-lock holder designed into the bicycle rack of U.S. Pat. No. 5,551,609, provide even less protection for the keyway.

There are several keyway protectors in the prior art. U.S. Pat. No. 5,092,142 discloses a sliding keyway protector. However, it requires that a rigid sheath with rails on which the protector cover slide be positioned on the U-lock crossbar. U.S. Pat. No. 5,535,609 discloses a rotating keyway protector. It, too, requires a rigid sheath on the U-lock crossbar to provide grooves in which the protector cover rotates. U.S. Pat. No. 5,832,762 also discloses a rotating keyway protector. While it does not require a sheath, it is secured to the U-lock crossbar by the shackle, so it is possible to lose the protector when the shackle is disengaged from the crossbar.

In order to protect the object being secured from damage, some U-locks are coated with a resilient material, such as vinyl. Neither the '142 or '609 keyway protectors would work with a resilient coating because they each require a rigid sheath for operation.

BRIEF SUMMARY OF THE INVENTION

An object of the present invention is to provide a keyway protector that can be used on a vinyl-coated U-lock.

The present invention is a keyway protector for use with a U-lock that has a crossbar and a shackle, with a keyway in the side of the crossbar. Optionally, the crossbar is sheathed in a resilient material, such as vinyl.

The U-lock keyway protector has a housing and the slider. The housing is shaped to hug the crossbar surface so that environmental contaminates cannot get between the housing and crossbar. Screws extend through holes in the housing and into threaded holes in the crossbar to secure the keyway protector to the crossbar. Optionally, the housing has legs that fit into openings in the vinyl sheath.

The housing inner surface has a shallow depression for the slider and a keyhole-shaped aperture between the depression and the outer surface of the housing. The larger hole of the aperture is at least as large as the keyway and the narrower slot extends away from the aperture hole toward one of the mounting holes.

The slider has a arched sheet and a knob. The sheet fits in the depression 56 and is arched to follow the curve of the crossbar. The sheet has a through hole at least the size of the keyway.

The slider moves between an open position, where the slider hole is aligned with the aperture hole to permit access to the keyway, and a closed position, where they are not aligned, denying access to the keyway. A knob is used to move the slider between the open and closed positions. A neck that fits and slides within the aperture slot connects the knob to the sheet, with the knob outside of the housing.

The slider can be held in the open or closed position either by friction. In the present implementation, the slider includes opposed pivoting arms with outwardly extending protrusions. The protrusions snap into opposed notches in the walls of the depression, one set of notches for the open position and one set of notches for the closed position.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
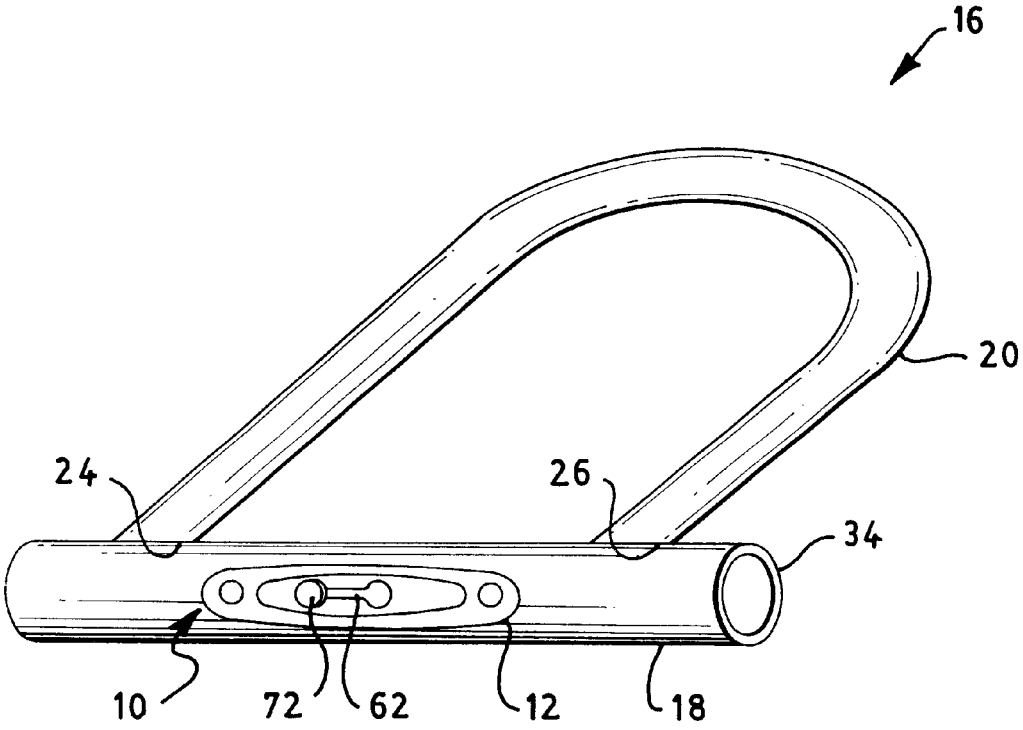
FIG. 1 shows the keyway protector of the present invention mounted to a U-lock.
Figure 2:
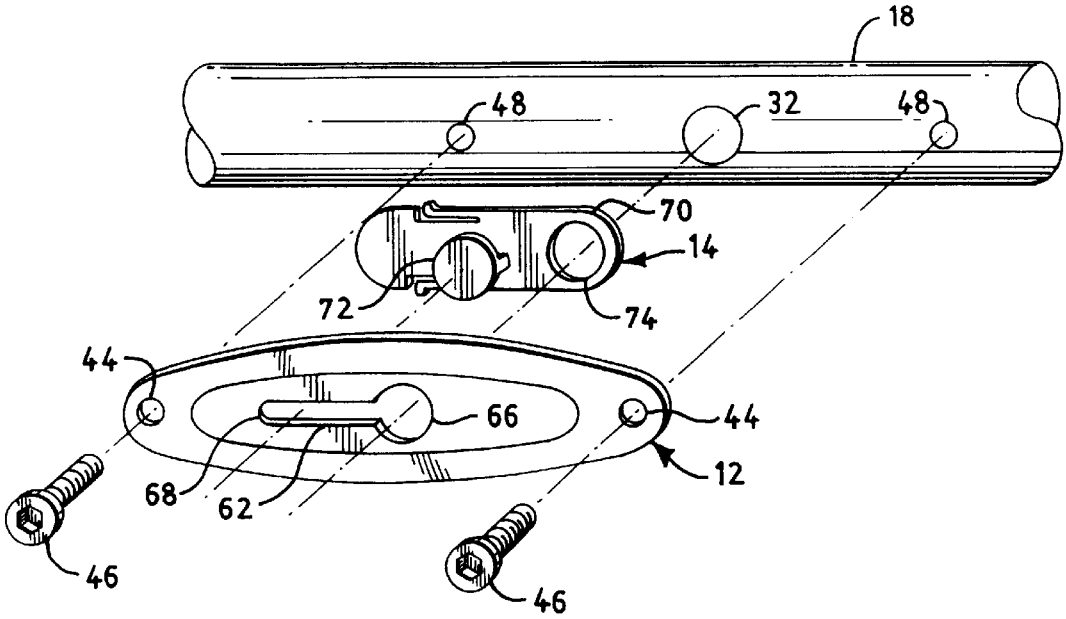
FIG. 2 shows an exploded view of the keyway protector of FIG. 1.
Figure 3:
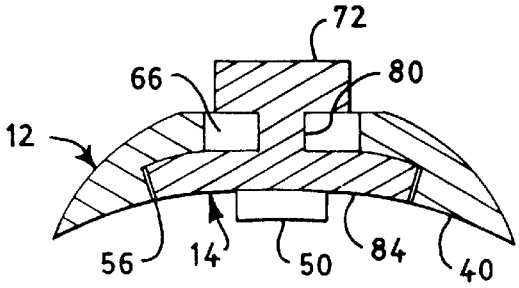
FIG. 3 shows an end cross-sectional view of the keyway protector of FIG. 1.
Figure 4:
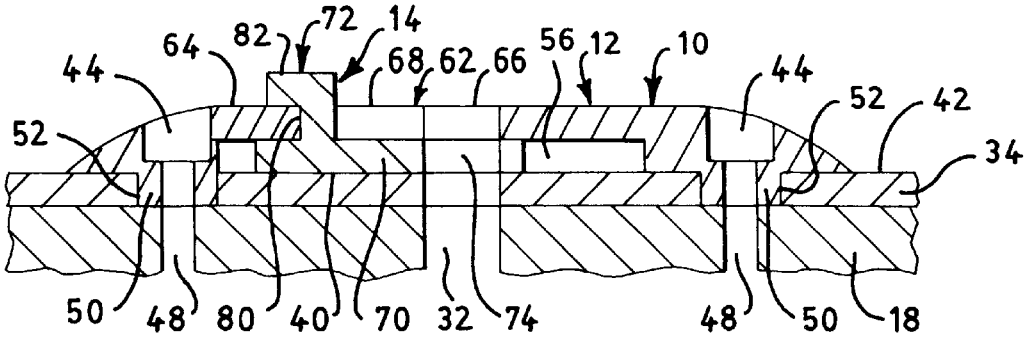
FIG. 4 shows a side cross-sectional view of the keyway protector of FIG. 1 in the open position.
Figure 5:
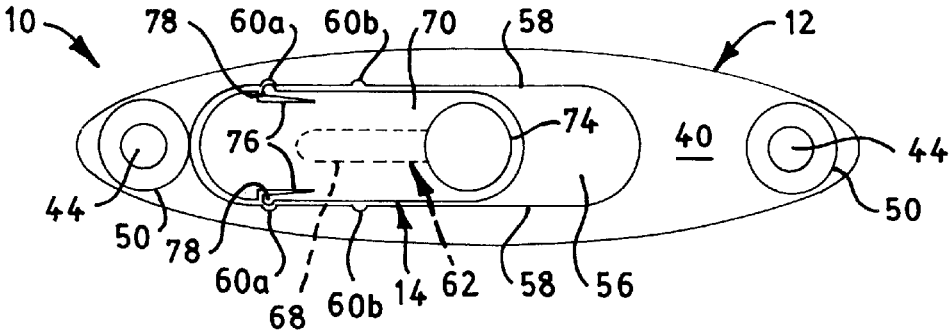
FIG. 5 shows an under side view of the keyway protector of FIG. 1 in the open position.
Figure 6:
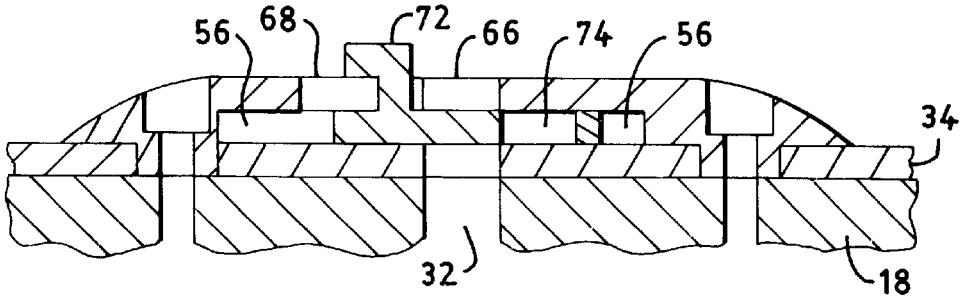
FIG. 6 shows a side cross-sectional view of the keyway protector of FIG. 1 in the closed position.
Figure 7:
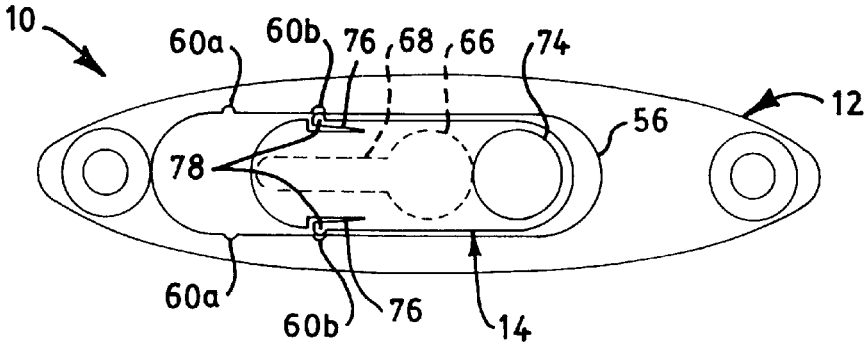
FIG. 7 shows an under side view of the keyway protector of FIG. 1 in the closed position.

The U-lock keyway protector of the present invention is for use with a U-type lock. The U-lock 16 has a crossbar 18 and a shackle 20. The crossbar 18 has a cylindrical shape and a pair of openings 24, 26 in its side to receive the legs of the shackle 20. Between these shackle openings 24, 26 is the keyway 32. Typically, the keyway 32 is located 180° around the circumference of the crossbar 18 from the shackle openings 24, 26, although this location is merely for convenience and may be anywhere around the circumference. Optionally, the crossbar 18 and shackle 20 are sheathed, as at 34, in a resilient material, such as vinyl, to minimize damage to other objects.

The U-lock keyway protector 10 of the present invention has two components, the housing 12 and the slider 14.

The housing 12 has an oblong shape and the inner surface 40 is shaped to hug the surface 42 of the crossbar 18 or resilient sheath 34. A relatively tight fit to the crossbar surface 42 is desired so that larger environmental contaminates cannot get under the housing 12 into the keyway. There are a pair of mounting holes 44 at the long ends of the housing 12. Screws 46 extend through the mounting holes 44 into threaded holes 48 in the crossbar 18 in order to attach the housing 12 to the crossbar 18. Optionally, the mounting holes 44 are recessed. Optionally, cylindrical legs 50 extend from the inner surface 40 into openings 52 in the crossbar vinyl sheath 34 in order to provide a more secure attachment for the housing 12, so that the housing 12 does not move relative to the crossbar 18.

The inner surface 40 of the housing 12 has a shallow depression 56 in which the slider 14 fits. There are two sets of opposed notches 60*a,* 60*b* (collectively, 60) in the side walls 58 of the depression 56. The notches 60 provide stops for the slider 14, as explained below.

There is a keyhole-shaped aperture 62 in the housing 12 between the bottom of the depression 56 and the outer surface 64. The larger access portion 66 of the aperture 62 is at least as large as the keyway 32 and is centered on the keyway 32 when the housing 12 is mounted to the crossbar 18. The narrower slot portion 68 extends away from the access portion 66 toward one of the mounting holes 44.

The second component is the slider 14, which has a arched sheet 70 and a knob 72. The thickness of the arched sheet 70 is substantially the same as the depth of the depression 56. The arched sheet fits within the depression 56 and is arched, as at 84, to follow the curve of the housing inner surface 40. This means that the arched sheet is also hugging the crossbar surface 42. The arched sheet 70 has a through hole 74 that is at least the size of the keyway 32.

As indicated above, the slider 14 has two positions, open and closed. When the slider 14 is in the open position, the hole 74 is aligned with the access portion 66 of the housing aperture 62 to permit access to the keyway 32. When the slider 14 is in the closed position, the hole 74 not aligned with the access portion 66, and access to the keyway 34 is denied. Friction can be used to hold the slider 14 in either the open or closed position. The implementation of the present invention uses an opposed pair of pivoting arms 76 with protrusions 78 that fit into the notches 60 in the depression walls 58. The slider 14 slides in the depression 56 until the protrusions 78 snap into the opposed notches 60. One pair of notches 60*a* is positioned to hold the slider 14 in the open position and the other pair of notches 60*b* is positioned to hold the slider 14 in the closed position.

The knob 72 is used to manually move the slider 14 between the open and closed positions. The knob 72 is attached to the arched sheet 70 by a neck 80. The knob 72 is slightly smaller than the access portion 66 of the housing aperture 62 so that the knob 72 can fit through the access portion 66 for assembly. The neck 80 is slightly narrower than the slot portion 68 of the housing aperture 62 so that the neck 80 can slide within the slot portion 68, with the knob 72 outside of the housing 12.

Optionally, the top 82 of the knob 72 is roughened or ridged to provide a better grip for the thumb or finger to push the slider 14.

The housing 12 is preferable composed of a relatively rigid material, such as a hard plastic. The slider 14 is preferably composed of a semirigid material, one that firmly holds its shape but that can be deformed, for example, so that the opposed pivoting arms 76 can pivot slightly.

Thus it has been shown and described a U-lock keyway protector which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A keyway protector adapted for use with a U-lock having a shackle and crossbar, said crossbar having a cylindrical outer surface and a keyway in said cylindrical outer surface, said keyway having a size, said keyway protector comprising:

(a) a housing and a slider;

(b) said housing including an inner surface and an outer surface, said inner surface shaped to conform with said crossbar cylindrical outer surface;

(c) said housing including mounting holes for attaching said keyway protector to said crossbar;

(d) said housing inner surface having a shallow depression;

(e) said housing including an aperture between said depression and said outer surface, said aperture having an access portion and a slot portion, the size of said access portion being approximately said keyway size and the width of said slot portion being smaller than said access portion size;

(f) said slider including an arched sheet fitted to said depression;

(g) said arched sheet having an opening with a size approximately said keyway size;

(h) said slider having an open position wherein said arched sheet opening is aligned with said access portion, and a closed position wherein said arched sheet opening is not aligned with said access portion; and (i) said slider including a knob outside of said housing for moving said slider between said open position and said closed position, said knob being attached to said arched sheet by a neck within said slot portion.

2. The keyway protector of claim 1 wherein said arched sheet includes a pair of opposed pivoting arms with protrusions and said depression includes two pairs of opposed notches, whereby said protrusions snap into one of said pair of notches to hold said slider in said open position and said protrusions snap into the other of said pair of notches to hold said slider in said closed position.

3. The keyway protector of claim 1 wherein said crossbar has a resilient sheath and said housing includes legs on said inner surface adapted to fit into holes in said sheath, said mounting holes extending through said legs.

4. The keyway protector of claim 1 wherein said cylindrical outer surface has threaded holes adjacent to said keyway and said keyway protector is attached to said crossbar by screws extending through said mounting holes and into said crossbar threaded holes.

* * * * *